US008110331B2

(12) United States Patent
Shimmura

(10) Patent No.: US 8,110,331 B2
(45) Date of Patent: Feb. 7, 2012

(54) ELECTROPHOTOGRAPHIC DEVELOPER AND IMAGE FORMING METHOD

(75) Inventor: Shoko Shimmura, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 324 days.

(21) Appl. No.: 12/558,743

(22) Filed: Sep. 14, 2009

(65) Prior Publication Data

US 2010/0068641 A1 Mar. 18, 2010

Related U.S. Application Data

(60) Provisional application No. 61/097,640, filed on Sep. 17, 2008.

(51) Int. Cl.
*G03G 9/00* (2006.01)

(52) U.S. Cl. ..... 430/110.4; 430/114.4; 430/111.41; 430/106.1

(58) Field of Classification Search ..... 430/110.4, 430/111.4, 111.41, 106.1
See application file for complete search history.

(56) References Cited

U.S. PATENT DOCUMENTS 7,209,684 B2 4/2007 Shimmura et al.
7,236,724 B2 6/2007 Shimmura

FOREIGN PATENT DOCUMENTS

JP 2004-037784 2/2004

*Primary Examiner* — Mark Chapman
(74) *Attorney, Agent, or Firm* — Turocy & Watson, LLP

(57) ABSTRACT

An electrophotographic developer including: magnetic particles, and a toner containing toner particles charged with the magnetic particles and having a particle diameter distribution, wherein the toner exhibits cumulative toner weight distributions of both square of charge amount $q^2$ [$C^2$] and attachment force F [N] per particle with respect to a representative toner particle diameter in the particle diameter distribution, giving a linear approximation of plots of the attachment force F [N] versus the square of charge amount $q^2$ [$C^2$] per particle at a plurality of corresponding cumulative toner weight ratios, and the linear approximation satisfies a slope of the linear approximation of from $5\times10^{20}$ to $3\times10^{22}$ and a squared multiple correlation coefficient ($R^2$) of 0.6 or more. As a result, the developer allows good control of transferability under the control of an electric field and allows a reduction in transfer residual amount of the toner.

9 Claims, 9 Drawing Sheets

ELECTROPHOTOGRAPHIC DEVELOPER AND IMAGE FORMING METHOD

CROSS REFERENCE TO RELATED APPLICATION

This application is based on and claims the benefit of priority from provisional U.S. Application 61/097,640 filed on Sep. 17, 2008, the entire contents of which are incorporated herein by reference.

TECHNICAL FIELD

The present invention relates to a developer and an image forming method using the developer for use in an electrophotographic system such as a copier or a printer.

BACKGROUND

In an electrophotographic image forming method and apparatus, a toner image is transferred from an image carrier to an intermediate transfer medium or a final transfer medium. However, it is difficult to transfer 100% of the toner. Further, in a color image forming method and apparatus adopting a tandem system, there is a problem that an image carrier which transports a toner image of a different color disposed on the downstream side contacts a previously transferred toner image and the previously transferred toner is reversely transferred to the image carrier for the different color disposed on the downstream side. A transfer residual toner is discarded after cleaning, the resultant waste toner should be treated, and therefore, such a transfer residual toner is not desirable from the viewpoint of labor and also an increase in cleaning cost. If the transfer residual toner collected by cleaning is recycled by returning it to a development unit, the powder characteristic of a toner in the development unit becomes broad because the charging characteristic and the attachment force characteristic of the recycled toner are different from those of a new toner, and therefore it is not desirable. Further, in the case of a cleanerless process in which the toner is collected in a development region without cleaning at the time of the subsequent image development operation, the transfer residual toner inhibits exposure or is not collected completely in the development region and is transferred to a transfer medium at the same time in the subsequent image transfer operation, etc. to cause image deterioration, and therefore it is not desirable. In addition to various problems similar to those of the transfer residual toner, in the case of a cleanerless process, a reverse transfer toner has a problem that it is collected in a development unit which develops a toner of a different color, whereby unexpected mixing of colors is caused and it is impossible to stably maintain the color reproducibility of color image, and therefore, it is not desirable.

For solving these problems, an attempt was made to control the attachment force between a toner and an image carrier and/or an intermediate transfer medium. For example, JP-A-2007-01129 proposes that the transfer characteristic is controlled by regulating the amounts of particles having a large particle diameter and a small particle diameter, and particles having a large attachment force and a small attachment force. Similarly, JP-A-2007-004128 proposes that the amount of particles having a high attachment force relative to an average attachment force is controlled. Further, JP-A-2004-037784 proposes that an average attachment force is controlled for improving the transfer characteristic. In these proposals, however, although a distribution of attachment forces as a combination of an electrostatic attachment force and a non-electrostatic attachment force is considered, the attachment force is composed of the sum of an electrostatic attachment force proportional to the square of charge amount of toner and a non-electrostatic attachment force independent of charge amount and the force of an electric field for moving a toner acts only on a charge of the toner. Therefore, even if the attachment force composed of the sum of two forces is the same, if the ratio of the electrostatic attachment force to the non-electrostatic attachment force is different, an electric field necessary for controlling the movement is different, and there arises a problem that it is impossible to strictly control the movement characteristic of the toner under the action of an electric field. JP-A-2000-66441 and JP-A-2000-98656 propose that the non-electrostatic attachment force is suppressed to low relative to the total attachment force. However, there is no teaching therein as to what developer should be used to favorably control the transferability of the developer and reduce the transfer residual amount based on the non-electrostatic attachment force which inevitably exists.

SUMMARY

Accordingly, a principal object of the present invention is to provide a developer which is favorable for controlling transferability through control by an electric field and gives less transfer residual amount.

As a result of the present inventor's study, it has been found that a developer having a good correlation between the charge amount and the attachment force of toner particles for each particle diameter level of toner particles constituting the developer is extremely favorable for achieving the above object. That is, the invention provides an electrophotographic developer, comprising: magnetic particles, and a toner containing toner particles charged with the magnetic particles and having a particle diameter distribution, wherein the toner exhibits cumulative toner weight distributions of both square of charge amount $q^2$ [$C^2$] and attachment force F [N] per particle with respect to a representative toner particle diameter in the particle diameter distribution, giving a linear approximation of plots of the attachment force F [N] versus the square of charge amount $q^2$ [$C^2$] per particle at a plurality of corresponding cumulative toner weight ratios, and the linear approximation satisfies a slope of the linear approximation of from $5\times10^{20}$ to $3\times10^{22}$ and a squared multiple correlation coefficient ($R^2$) of 0.6 or more.

As the representative particle diameter, it is preferred to use a particle diameter at 50% by number of the particles as a cumulative value as counted from the smaller particle diameter side (a so-called cumulative 50% by number-average particle diameter). Further, it is preferred that the representative toner particle diameter is composed of not a single particle diameter but three particle diameters (within a range of ±1 μm, respectively) including a cumulative 10% by number particle diameter and a cumulative 90% by number particle diameter in addition to the above-mentioned cumulative 50% by number particle diameter the smaller particle diameter side are adopted, and the linear approximation of plots of the attachment force F [N] versus the square of charge amount $q^2$ [$C^2$] is taken with respect to these three particle diameters so as to satisfy a slope of the linear approximation of from $5\times10^{20}$ to $3\times10^{22}$ and a squared multiple correlation coefficient ($R^2$) of 0.6 or more. Further, in order to obtain a more accurate approximation line of the $q^2$-F correlation and carry out accurate evaluation of transferability, it is preferred that as the plurality of cumulative toner weight ratios for the respective toner particle diameters, five cumulative toner weight ratios of 0.1, 0.3, 0.5, 0.7 and 0.9 are adopted to obtain the plots of the attachment force F [N] versus the square of charge amount $q^2$ [$C^2$] per particle.

According to the present invention, there is further provided an image forming method, comprising: developing an electrostatic latent image on an image carrier with a toner containing toner particles triboelectrically charged with magnetic particles and having a particle diameter distribution to form an image of the toner on the image carrier, and transferring the image of the toner onto an intermediate or a final transfer medium; wherein the toner on the image carrier exhibits cumulative toner weight distributions of both square of charge amount $q^2$ [$C^2$] and attachment force F [N] to the image carrier per particle with respect to a representative toner particle diameter in the particle diameter distribution, giving a linear approximation of plots of the attachment force F [N] versus the square of charge amount $q^2$ [$C^2$] per particle at a plurality of corresponding cumulative toner weight ratios, and the linear approximation satisfies a slope of the linear approximation of from $5\times10^{20}$ to $3\times10^{22}$ and a squared multiple correlation coefficient ($R^2$) of 0.6 or more.

A history of the present inventor's having completed the invention by conducting studies for achieving the above object is briefly described below.

Toner particles are a mass of plural composite fine particles having an average particle diameter of from 3 to 10 μm containing various components such as a binder resin, a colorant, a fixing aid, a charging aid and a fluidity regulator, and it is difficult to obtain a strict mono-dispersion of the particle diameters or component ratios. Further, the toner particles are triboelectrically charged by mixing the toner particles with carrier particles at a given weight ratio followed by stirring, and therefore, it is impossible to individually control the contact or frictional force between the toner particles and the carrier particles. Accordingly, a certain degree of distribution is generated in the particle diameter, the component ratio and the charge amount, respectively. It is possible to know the degree of the distribution by individually measuring the distribution of particle diameters or charge amounts, but these do not explain the easiness of the movement under the electric field (transfer characteristic).

As a result of study, it has been found that the transfer characteristic of a toner (developer) can be more accurately predicted by determining a relationship (a linear approximation) between the charge amount and the attachment force for each of the representative particle diameters of a toner having a distribution, plotting them on the same graph, and determining a slope and a squared multiple correlation coefficient of the linear approximation. The attachment force F can be expressed by the expression: $F=K\times q^2+F_0$, wherein $K\times q^2$ represents an electrostatic attachment force and $F_0$ represents a non-electrostatic attachment force. If particles have an identical particle diameter and an identical attachment force characteristic, the relationship between the attachment force and the square of charge amount is considered to be on this line, even if there is a distribution in the charge amount. At a different particle diameter, the non-electrostatic attachment force considered to be composed of a van der Waals force and a liquid bridge force is supposed to be theoretically different. Further, since the proportional constant K of the electrostatic attachment force is theoretically considered to be a function of particle diameter, dielectric constant or the like at a different particle diameter, the value of K is supposed to be different. However, the present inventor has further found, through experiments, that in a toner having a favorable transfer characteristic, a relationship between the square of charge amount and the attachment force is substantially linear even if particles with different particle diameters are contained. If it is a toner showing an identical attachment force characteristic even if the particle diameter or charge amount is different, almost 100% of the toner can be transferred by giving appropriate transfer conditions. By using a toner (developer) in which the squared multiple correlation coefficient of a linear approximation of the attachment force versus the square of charge amount is 0.6 or more and the slope of the linear approximation falls within the range of from $5\times10^{20}$ to $3\times10^{22}$ [$N/C^2$], a process less liable to cause transfer residual toner and reverse transfer toner can be obtained.

At a slope of the line of less than $5\times10^{20}$ [$N/C^2$] meaning that the effect of the non-electrostatic attachment force in the total attachment force of the toner particles to the photoconductor is extremely larger than that of the electrostatic attachment force, it becomes difficult to control the movement of the toner particles by the force of an electric field. On the other hand, at a slope of the line of more than $3\times10^{22}$ [$N/C^2$] meaning that the effect of the electrostatic attachment force is extremely larger than that of the non-electrostatic attachment force at an increased toner charge amount, the attachment force rapidly increases, and therefore, the toner should be used in a state where the toner charge amount is low. However, when the toner charge amount is low, the electric charge is easily reversed by electric discharge occurring in the transfer nip or in front or behind the transfer nip, and reverse transfer of toner (the toner on the transfer medium already transferred is reversely attached to the photoconductor at the time of transfer of the subsequent toner of a different color) is likely to be caused. By using a toner giving a slope of the line falling within the range of from $5\times10^{20}$ to $3\times10^{22}$ [$N/C^2$], a process in which transfer of residual toner and reverse transfer of toner are less likely to be caused, can be obtained.

DETAILED DESCRIPTION

Hereinafter, embodiments of the invention will be described.

(Developer)

A toner (base particles) may be composed of a binder resin (a polyester resin, a styrene-acrylic resin, a cyclic olefin resin or the like), a colorant (a known pigment such as carbon black, a fused polycyclic pigment, an azo pigment, a phthalocyanine pigment or an inorganic pigment, a dye or the like), a wax as a fixing aid (a synthetic wax of a fatty acid ester such as a polyethylene wax or a polypropylene wax, a petroleum-derived wax such as a paraffin wax or a microcrystalline wax, a vegetable-derived wax such as a rice wax or a carnauba wax), a charge control agent (CCA) and the like, and may be produced by pulverization or chemical production method with a known composition as described above. In addition to the above, inorganic fine particles for improving fluidity (silica, alumina, titanium oxide or the like), organic fine particles for the same purpose, etc. may be externally added to the base particles. The volume average particle diameter of the toner is from 3 to 8 μm, more preferably from 4 to 6 μm. In order to obtain toner particles excellent in transfer controllability according to the invention, it is preferred that a uniform coating layer of an external additive for improving fluidity such as fine particulate silica is formed on base particles by a wet process, and it is also preferred that as the base particles those formed by a wet process are used.

A carrier (magnetic particles) to be used for forming a two-component developer may be a known magnetic carrier such as resin particles incorporating ferrite, magnetite, iron oxide or magnetic powder. All or a part of the surface thereof may be coated with a resin (such as a fluoro-resin, a silicone resin or an acrylic resin). The volume-average particle diameter thereof is from 20 to 100 μm, more preferably from 30 to 60 μm. Further, various changes can be made without impairing the effect of the invention.

(Image Forming Process)

Figure 1:
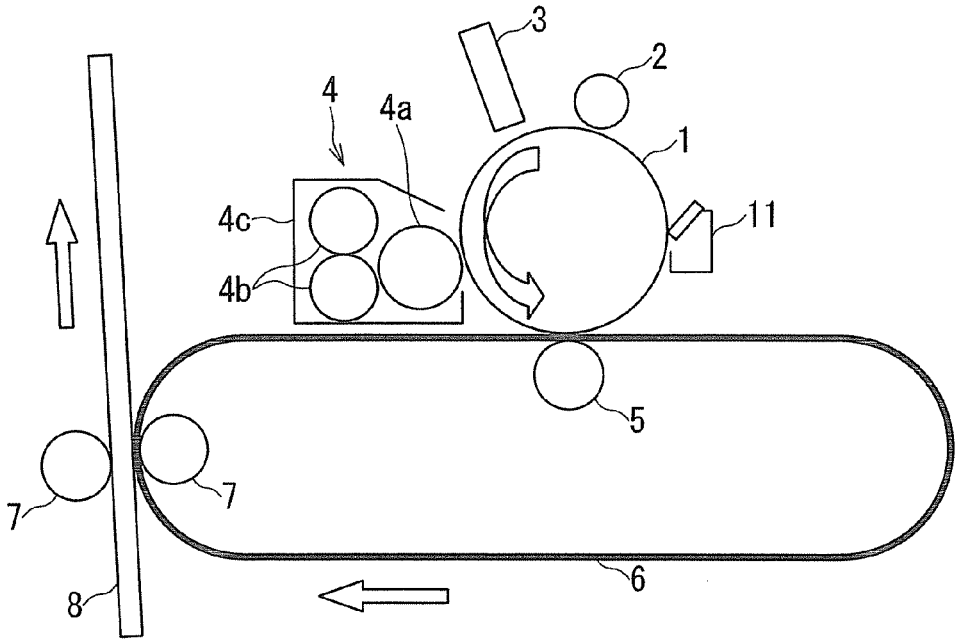
FIG. 1 is a schematic cross-sectional view for illustrating one example of an electrophotographic process and shows an N-th color printing unit of a color printing apparatus including a primary transfer section to an intermediate transfer medium and a secondary transfer section to a final transfer medium.

FIG. 1 is a schematic cross-sectional view for illustrating one example of an electrophotographic process and shows an N-th color printing unit of a color printing apparatus, a primary transfer section to an intermediate transfer medium and a secondary transfer section to a final transfer medium. By referring to FIG. 1, an N-th image carrier 1 composed of a belt, a roller and the like is uniformly charged to a desired voltage by a known charging device 2, for example, a non-contact charging device such as a corona charging device (a charger wire, a comb charger or scorotron) or a non-contact charging roller; a contact charging device such as a contact charging roller, a magnetic brush, a conductive brush or a solid charger; or the like. The image carrier 1 is a known photoconductor such as positively or negatively charged OPC or amorphous silicon, and may be laminated with a charge generating layer, a charge transport layer, a protective layer or the like. One layer may have two or more functions.

Further, by a known exposure device 3 such as a laser, an LED or a solid head, an electrostatic latent image is formed on the image carrier 1. Further, by an N-th developing device 4 including a developer carrier (developing roller) 4*a* incorporating a magnetic roller, a two-component developer layer containing a charged toner is formed on the developing roller 4*a* and conveyed to a developing position facing the image carrier 1, a charged toner is supplied to the electrostatic latent image on the image carrier 1 by magnetic brush development to visualize the image. To the developing roller 4*a*, a development bias is applied for forming an electric field such that a development toner is attached to the electrostatic latent image. The development bias may be formed by superimposing AC on DC so as to uniformly and stably attach the toner particles to the surface of the photoconductor.

The thus-formed toner image on the image carrier 1 is transferred to an intermediate transfer medium (belt, roller or the like) 6 by the action of a primary transfer unit 5 composed of a known transfer device such as a transfer roller, a transfer blade or a corona charger, and further transferred to a final transfer medium 8 such as paper transported from a transfer medium feeding device (not shown) under the action of a secondary transfer device 7 composed of a known transfer device. The transfer medium 8 receiving the transferred toner image is conveyed to a fixing section (not shown) and fixed by a known heating and pressurizing fixing system such as a heat roller and discharged to the outside of the electrophotographic apparatus.

Figure 2:
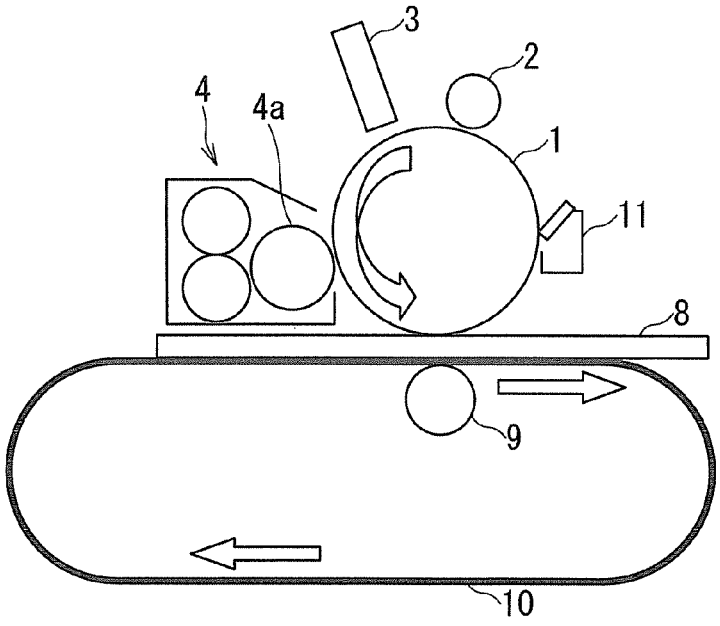
FIG. 2 is a schematic cross-sectional view for illustrating another example of an electrophotographic process and shows an N-th color printing unit of a color printing apparatus including a direct transfer section to a final transfer medium.

FIG. 2 is a schematic cross-sectional view for illustrating another example of an electrophotographic process and shows an N-th color printing unit of a color printing apparatus and a direct transfer section to a final transfer medium. In a process shown in FIG. 2, a toner image formed on an image carrier 1 is transferred to a final transfer medium 8 which has been placed on and transported by a transfer member transporting member 10 under the action of a transfer member 9 and fixed thereon without via an intermediate transfer medium. Except for this, the process shown in FIG. 2 is essentially the same as the process shown in FIG. 1.

In both processes shown in FIGS. 1 and 2, after the toner image is transferred to the intermediate transfer medium 6 or the direct transfer medium 8, the transfer residual toner on the image carrier 1 is removed by a cleaning device 11, and further, the electrostatic latent image on the imager carrier is eliminated by a charge removal device (not shown). The transfer residual toner removed by the cleaning device 11 is sent through a transport path by an auger or the like, stored in a waste toner box and discharged thereafter, or collected from the transport path in a developer storage tank in the developing device 4 (recycling system).

On the other hand, in a hopper of the developing device 4, 100 g to 700 g of a two-component developer composed of a carrier and a toner is contained, conveyed to the developing roller 4*a* by a stirring auger 4*b*, released from the developing roller 4*a* at the position of a releasing pole of a magnetic roller in the developing roller 4*a* after a portion of the toner is consumed due to development, and returned to the developer storage tank 4*c* by the stirring auger 4*b*. In the developer storage tank 4*c*, a known toner concentration sensor is installed, and when the concentration sensor detects a decrease in the toner amount, a signal is sent to a toner replenishing hopper and a new toner is replenished. The amount of toner consumption is estimated from integration of printing data or/and detection of the amount of development toner on the photoconductor, and the new toner may be replenished on the basis thereof. In addition, both methods of a sensor output and estimation of the amount of consumption may be used. A system in which the developer is automatically replaced by feeding also a new carrier little by little concurrently with or separately from the new toner and discarding the developer little by little may be employed.

Figure 3:
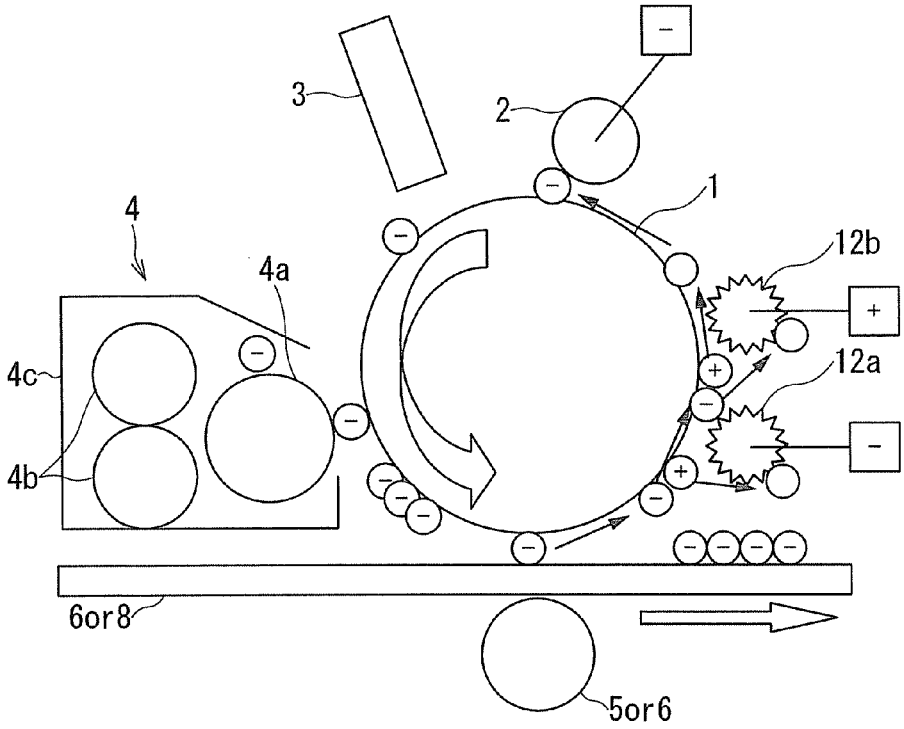
FIG. 3 is a schematic cross-sectional view for illustrating a configuration of one example of a full-color printing apparatus with a tandem structure.

In the case of a cleanerless process as shown in FIG. 3, which does not contain a cleaning device, an image carrier 1 is charged and exposed to light, an electrostatic latent image is developed with a toner, the resulting toner image is transferred to an intermediate transfer medium 6 or a direct transfer medium 8, and thereafter, the transfer residual toner on the image carrier is subjected to subsequent image forming steps of charge removal, charging and exposure to light, and then transported again to the development region, and the residual toner on the non-image area of the subsequent image is collected in a development unit by a magnetic brush which is a developer carrier. A memory disturbing member such as a fixed brush, felt, a rotating brush or a lateral rubbing brush may be disposed before or after the position of charge-removal of the image carrier. Further, a temporary collection member which once collects and releases the residual toner on the image carrier for recovery in the development unit, may be provided. Further, a toner charging device may be disposed on the photoconductor in order to adjust the charge amount of the transfer residual toner to a desired value. Further, a single member may be caused to carry out a part or all of the roles of toner charging device, memory disturbing member, temporary collection member and photoconductor charging member. A positive or/and negative DC or/and AC voltage may be applied to these members for the purpose of efficiently carrying out the functions. In the example shown in FIG. 3, a first lateral rubbing brush 12*a* and a second lateral rubbing brush 12*b* which carry out functions of memory disturbance, primary collection of residual toner and adjustment of charge amount of residual toner to a uniform value, are provided. Except that the cleaning device is not provided and a simultaneous developing and cleaning system is employed, the process shown in FIG. 3 is the same as the processes shown in FIGS. 1 and 2.

Figure 4:
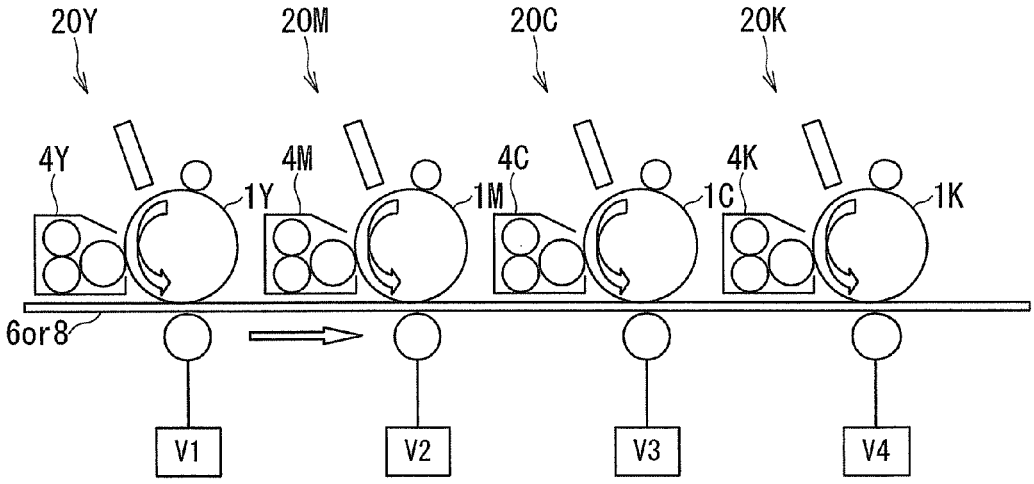
FIG. 4 is a schematic cross-sectional view of one example provided with two pairs of brushes having functions of memory disturbance, primary collection and toner charging in a cleanerless process.

FIG. 4 shows a four-drum tandem color image forming apparatus which includes four image forming units of four different colors each of which is provided with a development unit containing a toner of a different color: yellow (Y), magenta (M), cyan (C) or black (BK), an image carrier, a charging device, an exposure device, and a transfer device, and the four image forming units are arranged in tandem along the transport path of a transfer medium. The transfer medium may be either a direct transfer medium 8 or an intermediate transfer medium 6. For example, a case in which the image-forming units for colors of yellow, magenta, cyan and black are arranged in this order is described below.

As described with reference to FIG. 1, a yellow toner image is formed on a photoconductor 1Y in a yellow image forming unit 20Y and transferred to a transfer medium (6 or 8). In the case of direct transfer, paper or the like serving as a final transfer medium 8 is transported by a transport member such as a transfer belt or roller and supplied to a transfer region of the yellow image unit 1Y. As the material of the transfer belt (not shown), a rubber such as EPDM or CR rubber, a resin such as polyimide, polycarbonate, PVDF or ETFE may be used. The volume resistance thereof is preferably from $10^7$ Ωcm to $10^{12}$ Ωcm. In the case of intermediate transfer, a belt-like or roller-like intermediate transfer medium 6 is disposed to sequentially pass through the transfer regions of the respective image forming units. The surface resistance of the intermediate transfer belt is from $10^7$ Ωcm to $10^{12}$ Ωcm, and in a particular example, it was $10^9$ Ωcm. The material of the intermediate transfer belt may be a rubber such as EPDM or CR rubber or a resin such as polyimide, polycarbonate, PVDF or ETFE. A product obtained by laminating one layer or two or more layers of a resin sheet, a rubber elastic layer, a protective layer and the like may be used as the intermediate transfer belt. As the transfer system, a known transfer member such as a transfer roller, a transfer blade or a corona charger may be used.

Also in a magenta image forming unit 20M, a magenta toner image is similarly formed on a photoconductor 1M. The transfer medium (6 or 8) on which the yellow toner image has already been transferred is supplied to the transfer region of the magenta image forming unit, and the magenta toner image is transferred onto the yellow toner image by aligning the positions. At this time, there is a possibility that the yellow toner on the transfer medium contacts the magenta photoconductor, and a very small portion of the yellow toner may be reversely transferred to the magenta photoconductor depending on the toner charge amount or the intensity of a transfer electric field, but if the toner particles having the specified characteristics according to the invention are used, reverse transfer hardly occurs.

Subsequently, also in a cyan image forming unit 20C and a black image forming unit 20K, toner images are similarly formed, respectively, and sequentially superposed and transferred to the transfer medium. Also, there is a possibility that a very small portion of the former toners (yellow and magenta toners to the cyan photoconductor 1C, and yellow, magenta and cyan toners to the black photoconductor 1K) may be reversely transferred to the cyan photoconductor 1C and the black photoconductor 1K, but if the toner particles having the specified characteristics according to the invention are used, reverse transfer hardly occurs.

If the transfer medium (6 or 8) on which toners of four colors are superposed is the final transfer medium 8, the transfer medium 8 is released from the transport member, sent to a fixing section, subjected to a fixing procedure by a known heating and pressurizing fixing system such as a heat roller, and then, discharged out of the machine. If the transfer medium is the intermediate transfer medium 6, the toner images of four colors are transferred at one time to the final transfer medium 8 such as paper fed by a secondary transfer unit (corresponding to 7 in FIG. 1), and then, sent to the fixing section, subjected to a fixing procedure in the same manner, and discharged out of the image forming apparatus.

On the other hand, in the respective image forming units, as described in the process shown in FIG. 1, the photoconductors (1Y, 1M, 1C and 1K) return to the image forming process again after being subjected to the steps of charge removal, cleaning and the like, and in the development units (4Y, 4M, 4C and 4K), the toner density ratio may be adjusted at any time. Here, although the example in which the image forming units are arranged in the order of yellow, magenta, cyan and black is described, the order of the colors is not limited.

In the case of a four-drum tandem cleanerless process, the toners of four colors are fixed on the final transfer medium in the same manner as described above, whereas a device for cleaning the transfer residual toner and the reverse transfer toner is not provided on the photoconductor. As described in the above example shown in FIG. 3, at least one member selected from a memory disturbing member, a temporary collection member and a toner charging device may be provided. A single member may be caused to carry out one or more roles of other members. For example, as shown in FIG. 3, two lateral rubbing brushes playing all of the three roles may be disposed between the transfer region and the photoconductor charging member such that the tips of the brushes contact the photoconductor, and a voltage of the same polarity as that of the development toner is applied to the brush on the upstream side and a voltage of the opposite polarity to that of the development toner is applied to the brush on the downstream side. In the transfer residual toner, a toner of the opposite polarity and a toner of the same polarity having an extremely high charge are mixed. The toner of the opposite polarity contacting the brush of the same polarity slips through the brush with a charge thereof reversed or is collected by the brush once. The transfer residual toner reaching the brush of the opposite polarity on the downstream side has entirely the same polarity as that of the development toner. When the transfer residual toner contacts the brush of the opposite polarity, since a strong charge of the same polarity is attenuated, the transfer residual toner slips through the brush or is collected by the brush once. The transfer residual toner, which has been adjusted to a low charge amount and has lost an image structure because of mechanical contact with the brush, is charged together with the photoconductor by the contact or non-contact photoconductor charging member and adjusted to a charge amount equal to that of the development toner. Consequently, in the development region, the transfer residual toner in a non-image area for a new latent image is recovered in the development unit. The transfer residual toner in an image area is directly transferred to the transfer medium together with the toner newly supplied from the development unit. As described above, the transfer residual toner is collected in the development unit by adjusting the charge amount. However, in the case of a four-drum tandem apparatus, when the former color toner is reversely transferred, the toner is also collected in the development unit, and therefore, a problem arises that when the reverse transfer amount is large, the color of the toner in the development unit changes. However, when the developer according to the invention is used, the reverse transfer amount is suppressed to a very low level, and therefore, the problem of mixing of colors is significantly reduced. Further, if the transfer residual amount is large, it is liable that the toner amount temporarily collected in the memory disturbing brush is large, and a step of discharging from the brush is frequently and seriously needed, or the brush cannot carry out a specified function. However, when the developer according to the invention is used, the transfer residual amount can be extremely reduced, and therefore, the toner amount temporarily collected in the memory disturbing brush is small, and discharge from the brush is easy, and a cleanerless process can be maintained over a long period of time while keeping a high image quality.

The use of a contact-type image carrier-charging device is effective for preventing ozone degradation of a photoconductive layer of the photoconductor (image carrier) and extending the life of the photoconductor. The charging device uses a charging roller including, for example, at least an elastic layer made of, for example, ion conductive rubber or carbon dispersed rubber and having a volume resistance of about $10^4$ to $10^8$ Ωcm. The charging roller is caused to contact the photoconductor at constant pressure and to rotate following the rotation of the photoconductor, or to rotate at the same speed as that of the photoconductor or a speed slightly different from that of the photoconductor. A DC voltage of 400 to 1000 V is applied to the shaft of the charging roller, so that an electric charge is injected to the surface of the photoconductor to charge the photoconductor to a specified potential. In the case of the cleanerless process, there is a possibility that the transfer residual toner remains on the photoconductor when the photoconductor is charged. In the case of the cleanerless tandem system, there is a possibility that in addition to the transfer residual toner, the reverse transfer toner remains on the photoconductor when the photoconductor is charged. Thus, a web, a brush, a blade or the like for cleaning the charging roller be brought into contact with the photoconductor always or as required.

In order to obviate the problem accompanied with the use of a contact-type image carrier-charging device of requiring a cleaning operation for removing the soil, it is also possible to use a non-contact-type image carrier-charging device. For example, a charging roller having a similar electrical resistance as in the contact type is disposed with a spacing of 20-100 μm from the image carrier, and a DC voltage of 50-200 V is applied to the shaft of the charging member to cause a minute gap from the image carrier, thereby uniformly charging the image carrier. Compared with the corona charging system, the discharge distance becomes shorter, so that less ozone is generated to reduce the deterioration of the image carrier. It is also possible to superpose an AC voltage with the DC voltage.

(Evaluation Method for Developer)

A charge amount distribution of a toner on a photoconductor is measured by using E-SPART Analyzer (Hosokawa Micron Co.). As is well known, with the use of E-SPART Analyzer, the particle diameter and charge amount of the toner particles can be simultaneously measured. Therefore, when the measurement data are rearranged by taking the particle diameter on the abscissa, the measurement results of charge amount distribution corresponding to the particle diameter are obtained. The development toner amount on the photoconductor for measurement may suitably be set to an amount corresponding to about one layer, and preferably from 200 to 300 μg/cm$^2$. This corresponds to a number of particles measured of 15000 or more.

An attachment force distribution is determined as follows. The toner is attached to a photoconductor sheet in an amount corresponding to about one layer by the development, and the rotational speed of an ultracentrifuge is gradually increased, and a distribution of particle sizes of toner detached from the photoconductor sheet is determined by an image processing for the respective centrifugal forces. The centrifugal force applied to the toner particles by the rotation of the ultracentrifuge is taken as the attachment force between the photoconductor and the toner particles detached from the photoconductor sheet at the rotational speed. The rotational speed is increased from 10000 rpm to 100000 rpm, and the number of particles measured should be 15000 or more.

Figure 5A:
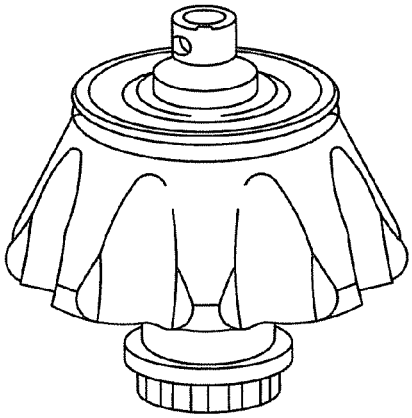
FIG. 5A is an outline view of an angle rotor for an ultracentrifuge which is used for measuring the attachment force of a toner by mounting a sample plate to which toner particles are attached thereon.
Figure 5B:
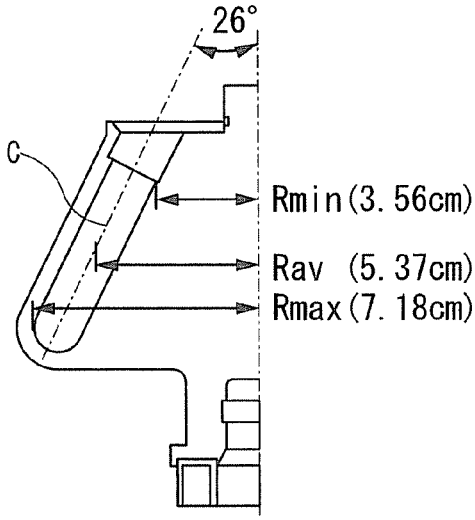
FIG. 5B is a cross-sectional view of the angle rotor shown in FIG. 5A.
Figure 6A:
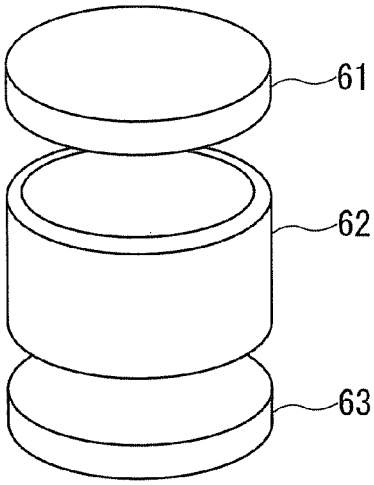
FIG. 6A is an exploded view of a cell to be used for mounting a sample plate to which toner particles are attached on an ultracentrifuge.
Figure 6B:
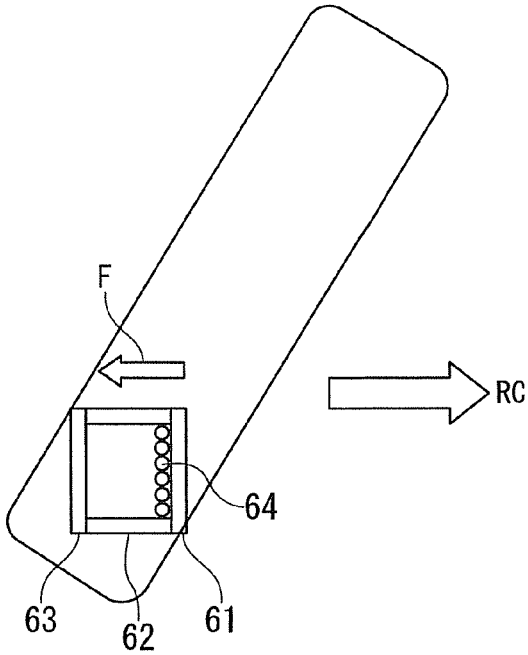
FIG. 6B is a cross-sectional view of a rotor in which the cell shown in FIG. 6A is placed.

More specifically, as disclosed in JP-A-2002-328484, the attachment force is measured by using a centrifugal separator and adopting a system of calculation from a centrifugal force when the toner particles are detached from the attached substance. A centrifugal separator ("CP100MX" manufactured by Hitachi Koki Co., Ltd.) described in JP-A-2002-328484 may be used. The rotor has a structure shown in FIG. 5A (perspective view) and FIG. 5B (sectional view), and a cell is inserted in the C part thereof. The cell has a structure shown in FIG. 6A as an exploded view, and is composed of a sample attachment plate 61, a spacer 62 and a detached toner attachment plate 63. After a photoconductor sample 64 to which the toner particles have been attached under the development conditions is stuck to the inner face of the sample attachment plate 61, as shown in FIG. 6B, the photoconductor sample 64 is placed in each cell insertion part C of the rotor inclined to the rotational center RC such that the photoconductor sample 64 becomes parallel to the rotational center of the rotor.

A centrifugal acceleration RCF applied to the toner particles on the sample 64 placed in the cell by the rotation of the rotor is expressed by the following equation (1).

$$\mathrm{RCF}=1.118\times10^{-5}\times r\times N^2\times g \quad (1)$$

r: distance between the position of the sample placed and the rotational center [cm]

N: rotational speed [rpm]

g: gravitational acceleration [kgf]

Accordingly, when the weight of one toner particle is m [kg/particle], the centrifugal force F [N] applied to the toner particles is calculated from the following equations (2) and (3).

$$F=\mathrm{RCF}\times m \quad (2)$$

$$m=(4/3)\pi\times r^3\times\rho \quad (3)$$

r: sphere equivalent radius [cm]

ρ: toner specific gravity [kg/cm$^3$]

In the measurement, (1) a sheet having a surface layer identical to that of the photoconductor to be measured for the attachment force is prepared. The photoconductor sheet may be used as such. However, in the case of a photoconductor having a laminate structure including a photoconductive layer (preferably composed of a charge transport layer and a charge generating layer) and a surface protective layer are laminated in this order, a sheet having the same surface layer as the surface protective layer may be used to obtain substantially the same measurement result. For a sample preparation, the photoconductive sheet is wrapped around an aluminum-based tube and placed at the position of the photoconductive drum while the photoconductive layer is grounded. Then, a toner sample is attached to the sheet surface under the development conditions in an amount of preferably from about 150 to 250 μg/cm$^2$ (an amount corresponding to one layer of toner particles or less).

(2) Subsequently, the sheet to which the toner is attached is cut into a size corresponding to the sample attachment plate 61 and stuck to the plate 61 on the side thereof contacting the spacer 62 via a double-sided adhesive tape.

(3) The outer circumference diameters of the plates 61 and 63 and the spacer 62 used in the following measurement example are 7 mm, respectively, the thickness and height of the tubular spacer 62 are 1 mm and 3 mm, respectively. As shown in FIG. 6B, the plate 61, the spacer 62 and the plate 63 are placed in the cell in this order such that the face of the plate 61 opposite to the face thereof carrying the sample faces the rotational center, the cell is placed in the angle rotor, and the angle rotor is mounted in the ultracentrifuge (not shown).

(4) After the ultracentrifuge is rotated at 10000 rpm, the plate 63 is taken out, and the attached toner particles are photographed with a CCD camera to form an electronic image. From one sample, four regions with a size of 1200×1600 pixels at such a magnification as to give one pixel having a size of about 0.1 to 0.4 μm are taken out, and after photographing, the attached toner is removed form the attachment plate 63 by sticking to a mending tape. The tape carrying the attached toner is attached is stuck to a sheet of white paper. Then, the reflection density thereof is measured by a Macbeth densitometer, and the toner amount per unit area is obtained from the calibration equation prepared in advance between the reflection density and toner amount.

(5) The sample plate 61, the plate 63 having removed the attached toner and the spacer 62 are placed in the rotor again in combination, and the ultracentrifuge is rotated at 15000 rpm. Then, the plate 63 is taken out, and the toner amount attached to the plate 63 is photographed. This procedure is repeated while increasing the rotational speed up to 100000 rpm.

(6) From the electronic images photographed with respect to all the measured rotational speeds, particle size distributions of the attached particles for the respective rotational speeds are measured, and the total amount of the measured particles (of which the volume is calculated from the particle diameter and the weight is calculated from the specific gravity, and the weights of all the particles are summed) are corrected by the toner amount obtained in the above (4) (multiplied by a certain factor such that the total amount of the measured toner sample becomes the toner amount obtained in (4)). Based on the corrected total toner amount, distributions of particle diameters are calculated in increments of 0.5 μm. The centrifugal forces applied to the toner for each particle diameter and each rotational speed are calculated from the following equation:

$$F=\mathrm{RCF}\times m \quad (2).$$

(7) Since the attachment force is greatly affected by the toner charge amount, it is preferred to prepare the measurement sample by attaching the toner according to the development conditions in the actual process, in order to carry out accurate measurement.

In the above, a method of increasing the rotational speed of the ultracentrifuge from 10000 rpm by an increment of 10000 rpm is described, whereas the measurement can be carried out by increasing the rotational speed from 5000 rpm by an increment of 5000 rpm.

Separately, the particle size distribution is measured by using a coulter counter, and the above particle size distribution measurement results obtained by the E-Spart Analyzer and the image processing are corrected so that the particle diameters of the cumulative 10% by number particle diameter (D10pop), cumulative 50% by number particle diameter (D50pop) and cumulative 90% by number particle diameter (D50pop) conform to those according to the coulter counter measurement (that is, the particle size distributions are standardized with the measurement results obtained by the Coulter counter).

Figure 7:
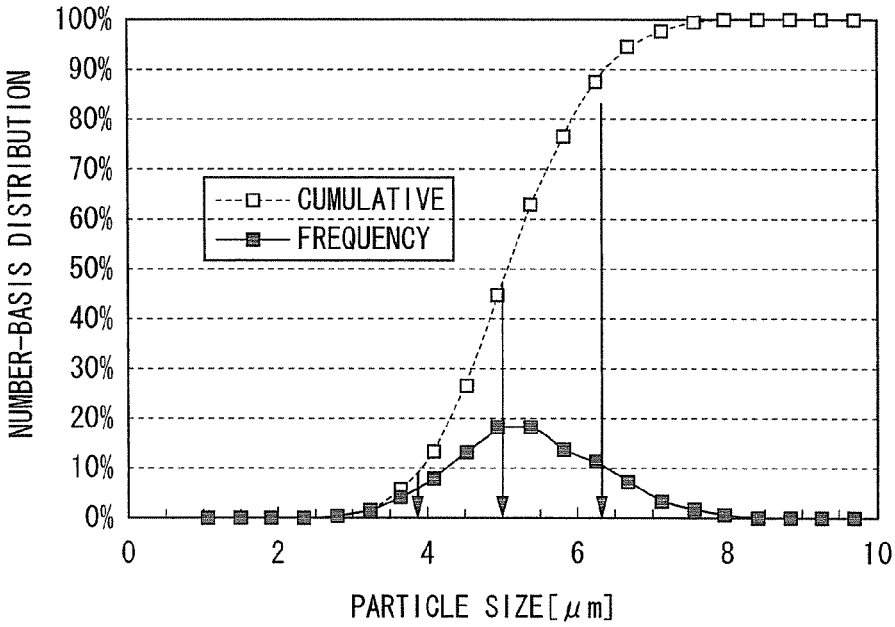
FIG. 7 is a graph showing one example of a number-basis distribution of toner particle diameters.
Figure 8:
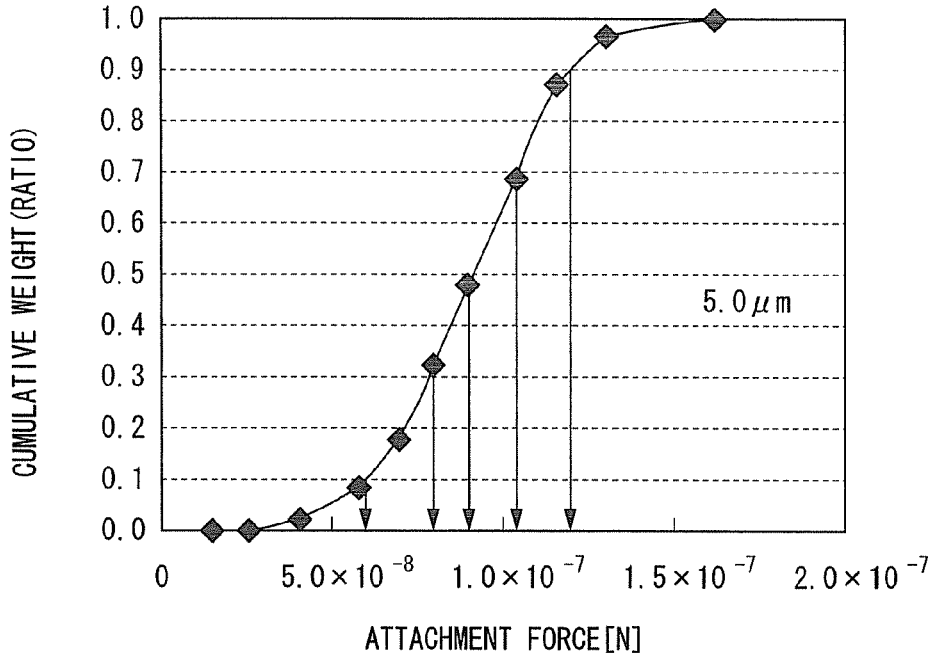
FIG. 8 is a graph showing one example of a distribution of attachment forces of particles having a particle diameter of 5.0 μm.
Figure 9:
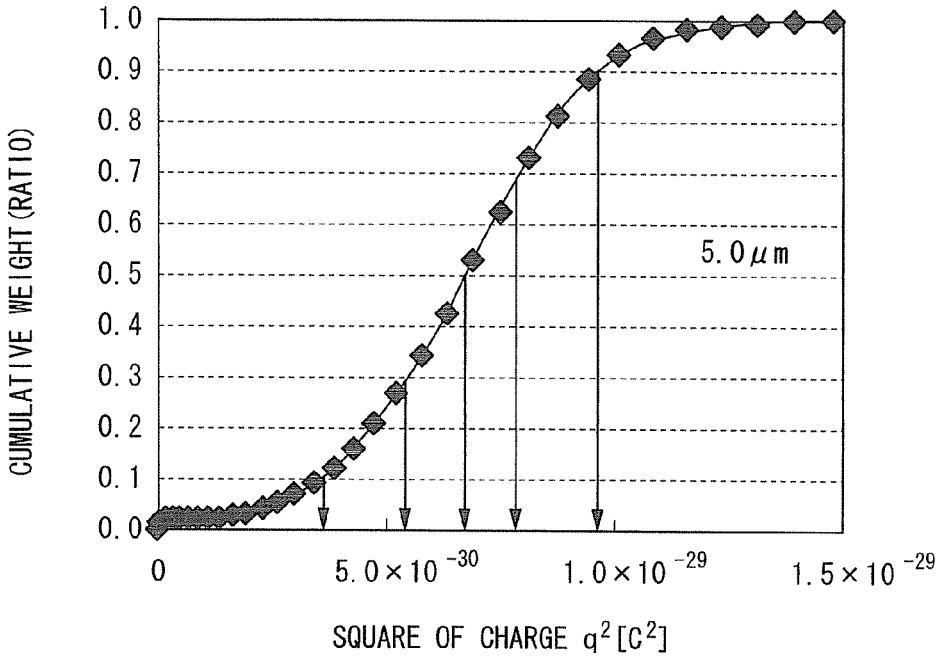
FIG. 9 is a graph showing one example of a distribution of charge amounts of particles having a particle diameter of 5.0 μm.
Figure 10:
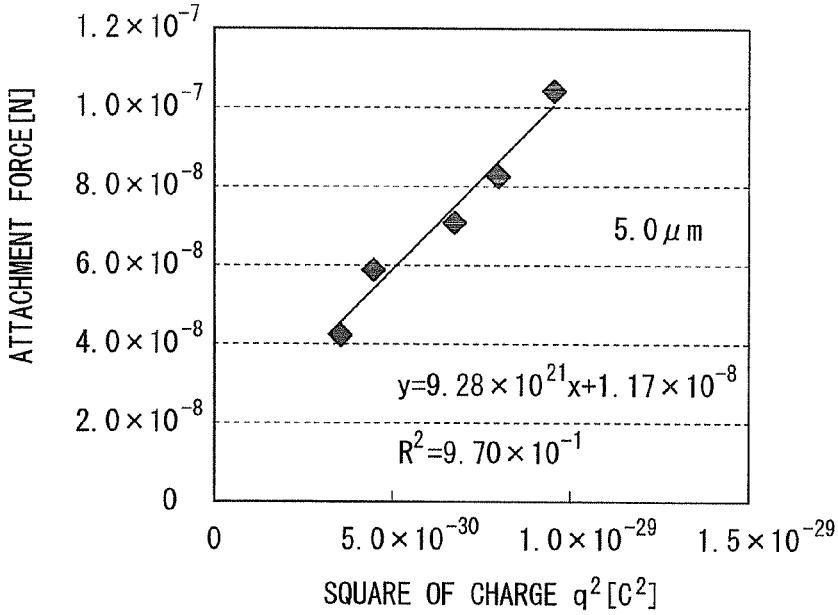
FIG. 10 shows a graph representing a relationship between the charge amount and the attachment force of particles having a particle diameter of 5.0 μm, and a linear approximation and a squared multiple correlation coefficient.
Figure 11:
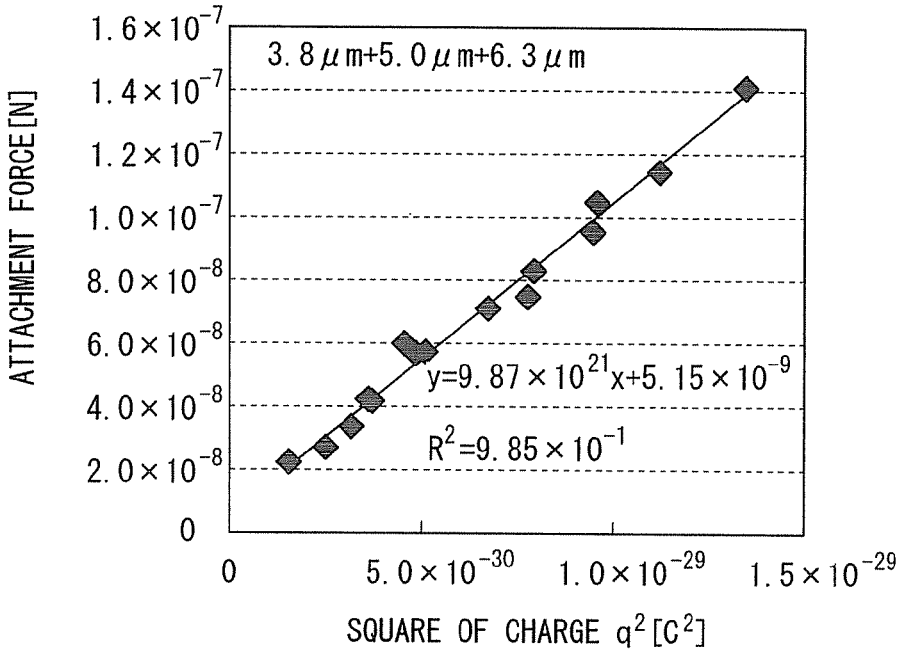
FIG. 11 shows a graph representing a relationship between the charge amount and the attachment force of particles having particle diameters of 3.8 μm, 5.0 μm and 6.3 μm, and a linear approximation and a squared multiple correlation coefficient.

The charge amount distribution measurement results are extracted as the toner weights versus the square of charge amount q per particle for each particle diameter and a graph of cumulative toner weights cumulated from the side of the lower charge amount is created. Similarly, the attachment force distribution measurement results are extracted as the toner weights versus the attachment force F for each particle diameter and a graph of cumulative toner weights cumulated from the side of the lower attachment force is created. It is assumed that as the charge amount is higher, the attachment force is larger, and the charge amounts and the attachment forces are linked to each other for particles having an equal particle diameter, and from the graphs of cumulative toner weights versus $q^2$ and cumulative toner weights versus F for each of D10pop, D50pop and D90pop (±1 μm, respectively) in the particle size distribution, the values of $q^2$ and F when the cumulative weight ratios are 10%, 30%, 50%, 70% and 90% are read out. As one example, in the case of a toner with a particle size distribution as shown in FIG. 7, D10pop was 3.8 μm, D50pop was 5.0 μm, and D90pop was 6.3 μm. Then, the charge amount distributions and the attachment force distributions for the respective particle diameters were extracted, and as shown in FIGS. 8 and 9, the values of $q^2$ and F in the case of the above-mentioned cumulative weight ratios were read out from the graphs. 5 data of the combination of the values of $q^2$ and F read out for the particles having a particle diameter of 5.0 μm were plotted on a graph (FIG. 10) to calculate a linear approximation. As a result, the expression: $Y=9.28\times10^{21}\times X+1.17\times10^{-8}$ was obtained and the R-squared value was 0.97. In the equation, Y=F, and $X=q^2$. Further, a total of 15 data of the combination of the values of $q^2$ and F read out from the graphs of the attachment force distributions and charge amount distributions for the respective particles having particle diameters of 3.8 μm, 5.0 μm and 6.3 μm were plotted on a graph (FIG. 11) to calculate a linear approximation. As a result, the expression: $Y=9.87\times10^{21}\times X+5.15\times10^{-9}$ was obtained and the R-squared value was 0.985.

[Toner Production Examples]

Toners A-E were produced in the following manner.

(Toner A)

20 wt. parts of Carmine 6B (pigment), 70 wt. parts of polyester resin and 10 wt. parts of rice wax were kneaded and coarsely pulverized to obtain colored resin particles. 20 wt. parts of the colored resin particles were dispersed together with 1 wt. part (as solid) of surfactant by means of a homogenizer exerting a mechanical sharing force to form a dispersion containing minute particles having an average particle diameter of 0.2 μm. The dispersion was then stirred while adding thereto 0.3 wt. part of hydrochloric acid and 0.3 wt. part of amine and heated to 70° C. to cause agglomeration and bonding up to about 5 μm.

Into the dispersion, 3 wt. parts of silica (RX200) having a primary particle diameter of 12 nm and 0.5 wt. part of titanium oxide (LU-227) were added, and the resultant dispersion was cooled down to room temperature under stirring, followed by filtration, washing with water and drying to obtain polyester resin-based toner base particles containing wax and pigment and carrying silica fine particles and titanium oxide uniformly attached to the surface thereof.

Thereafter, 1 wt. part of silica having a primary particle diameter of 100 nm was externally added by using a Henschel mixer, whereby toner particles A having a 50% by number-average particle diameter (D50pop) of 5.0 μm and a ratio of a 50% volume-average particle diameter (D50vol) to D50pop of 1.11 were obtained. This toner exhibited good uniform dispersibility because the pigment was dispersed along with the resin in the dispersion. The wax was dispersed in the particles at an appropriate particle diameter, and also small inorganic fine particles were also added in the liquid, whereby toner particles containing components uniformly dispersed therein, and exhibiting high uniformity of charging characteristic and attachment force characteristic, were obtained.

(Toner B)

20 wt. parts of Carmine 6B (pigment), 55 wt. parts of polyester resin and 10 wt. parts of rice wax were kneaded and coarsely pulverized to obtain colored resin particles. 20 wt. parts of the colored resin particles were dispersed together with 1 wt. part (as solid) of surfactant by means of a homogenizer exerting a mechanical sharing force to form a dispersion containing minute colored resin particles having an average particle diameter of 0.2 μm. Separately, the same polyester resin alone was formed in a similar manner as described above to form a dispersion containing minute colorless resin particles having an average particle diameter of 0.2 μm. Similarly as in the production of Toner A, the above-prepared colored resin particle dispersion was stirred while adding 0.3 wt. part of hydrochloric acid and 0.3 wt. part of amine per 100 wt. parts of the colored resin particles and heated to 70° C. to cause agglomeration up to about 5 μm, and then the above-prepared dispersion containing 15 wt. parts of the minute colorless resin particles were added thereto under stirring and heated to 70° C. to obtain a dispersion containing fine particles encapsulated with the resin alone and having an average diameter of 6.5 μm.

Into the dispersion, 3 wt. parts of silica (RX200) having a primary particle diameter of 12 nm and 0.7 wt. part of titanium oxide (LU-227) were added, and the resultant dispersion was cooled down to room temperature under stirring, followed by filtration, washing with water and drying to obtain polyester resin-based toner base particles containing wax and pigment and carrying silica fine particles and titanium oxide uniformly attached to the surface thereof.

Thereafter, 1 wt. part of silica having a primary particle diameter of 100 nm was externally added by using a Henschel mixer, whereby toner particles B having a 50% by number-average particle diameter (D50pop) of 6.3 μm and a ratio of a 50% volume-average particle diameter (D50vol) to D50pop of 1.13 were obtained.

(Toner C)

Toner C was produced in the same manner as in the production of Toner A except that the colored resin particles were prepared with the resin and pigment by omitting the rice wax, and the amount of the titanium oxide was increased to 0.7 wt. part for production of the toner base particles.

(Toner D)

Toner D was produced in the same manner as in the production of Toner A except for changing the silica to 3 wt. parts of silica (R974) and increasing the amount of the titanium oxide to 1.0 wt. part for production of the toner base particles.

(Toner E)

Toner E was produced in the same manner as in the production of Toner D except for changing the temperature for the agglomeration and bonding of the colored resin particles from 70° C. to 85° C. in order to provide a more spherical toner.

The above-obtained toners A to E are summarized in the following Table 1.

TABLE 1

| Toner | D50pop [μm] | D50vol [μm] | D50vol/ D50pop | Silica*1 | Titanium oxide | Base particles |
|---|---|---|---|---|---|---|
| A | 5.0 | 5.6 | 1.11 | Neutral product 3% | 0.5% | As described above |
| B | 6.3 | 7.1 | 1.13 | Neutral product 3% | 0.7% | The base particles of A were reformulated into a capsule type as described above. |
| C | 5.7 | 6.7 | 1.18 | Neutral product 3% | 0.7% | Identical to A except for the omission of wax and an increase in titanium oxide. |
| D | 4.8 | 5.4 | 1.13 | Acidic product 3% | 1.0% | Identical to A except for changes in silica and titanium oxide |
| E | 4.8 | 5.5 | 1.15 | Acidic product 3% | 1.0% | Identical to A except that the heat processing was carried out at a higher temperature than A, resulting a higher sphericity. |

*1: Neutral silica: RX200 (pH: about 7)
Acidic silica: R974 (pH: 3-4)

(Developer Production Examples)

By coating ferrite particles with 5.5 wt. % of a resin as shown in the following Table 2, Carriers X to Z shown in the following Table 2 and each having an average diameter of 40 μm, were prepared.

TABLE 2

| Carrier | Resin | Amount of charging aid *2 |
|---|---|---|
| X | Silicone resin | 7% by weight |
| Y | Silicone resin | 5% by weight |
| Z | Acrylic-silicone resin | 0% |

*2: An amine-type charging aid was included in an indicated amount within the coating resin.

12 types of developers shown in the following Table were produced by mixing the toners in the above Table and the carriers in the above Table 2 in combination as shown in the following Table 3 at a mixing ratio of the toner to the carrier (T/D) (% by weight) as shown in the following Table 3.

TABLE 3

| Toner | Carrier | T/D |
|---|---|---|
| A | X | 7.0% |
| A | X | 8.5% |
| A | Z | 7.0% |
| B | X | 7.0% |
| B | Y | 7.0% |
| B | Z | 7.0% |
| C | X | 7.0% |
| C | Z | 7.0% |
| D | X | 7.0% |
| D | X | 8.5% |
| E | X | 5.0% |
| E | X | 7.0% |

Figure 12:
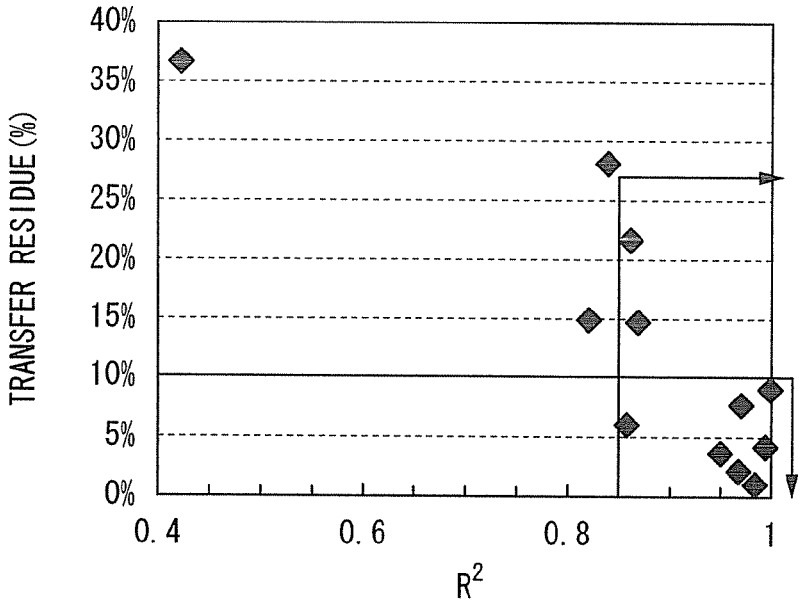
FIG. 12 is a graph showing a relationship between the transfer residual amount of each developer at a transfer voltage of 200 V and the squared multiple correlation coefficient of a linear approximation of the attachment force characteristic versus the square of charge amount of particles with a 50% by number average particle diameter.
Figure 13:
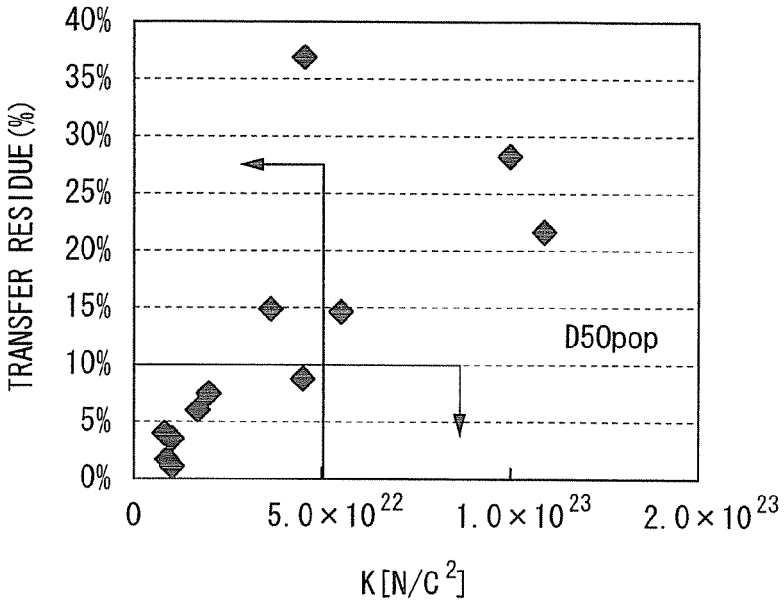
FIG. 13 is a graph showing a relationship between the transfer residual amount of each developer at a transfer voltage of 200 V and the slope of a linear approximation of the attachment force characteristic versus the square of charge amount of particles with a 50% by number-average particle diameter.
Figure 14:
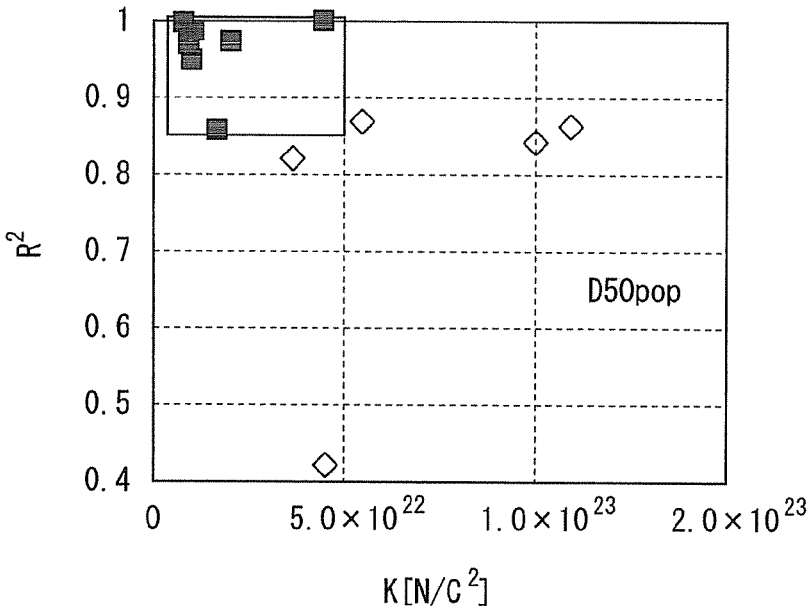
FIG. 14 is a graph showing a relationship between the slope and the squared multiple correlation coefficient of a linear approximation of the attachment force characteristic versus the square of charge amount of particles with a 50% by number-average particle diameter. ■ indicates a toner (developer) showing a transfer residual amount of 10% or less; and ◇ indicates a toner (developer) showing a transfer residual amount more than 10%.

Each of these developers was placed in an M image forming unit of an electrophotographic image forming apparatus ("e-Studio 5520", manufactured by Toshiba Tec Corporation), and a transfer residual amount at a transfer voltage of 200 V was measured. Such a low voltage was used in order to suppress the occurrence of electric discharge in the vicinity of the transfer nip, thereby preventing reverse transfer. Further, according to the above-mentioned procedures described with reference to FIGS. 5 to 11, the charge amount distribution and the attachment force distribution of the development toner were measured. FIG. 12 shows a relationship between the transfer residual amount of each developer at a transfer voltage of 200 V and the squared multiple correlation coefficient of a linear approximation of the attachment force characteristic versus the square of charge amount of the particles with D50pop. It is found that the toner showing a transfer residual ratio of 10% or less is a toner (developer) showing a squared multiple correlation coefficient of 0.85 or more. FIG. 13 shows a relationship between the transfer residual amount of each developer at a transfer voltage of 200 V and the slope of a linear approximation of the attachment force characteristic versus the square of charge amount of particles with D50pop. It is found that the toner showing a transfer residual ratio of 10% or less is a toner (developer) showing a slope K of $5\times10^{22}$ or less. FIG. 14 shows a relationship between the slope and the squared multiple correlation coefficient of a linear approximation of the attachment force characteristic versus the square of charge amount of particles with D50pop. ■ indicates a toner (developer) showing a transfer residual amount of 10% or less; and ◇ indicates a toner (developer) showing a transfer residual amount more than 10%. From this graph, it is found that in order to achieve a transfer residual amount of 10% or less, it is appropriate to use a toner showing a slope of a linear approximation of the attachment force versus the square of charge amount of $5\times10^{22}$ [N/C$^2$] or less and a squared multiple correlation coefficient thereof of 0.85 or more may be used.

Figure 15:
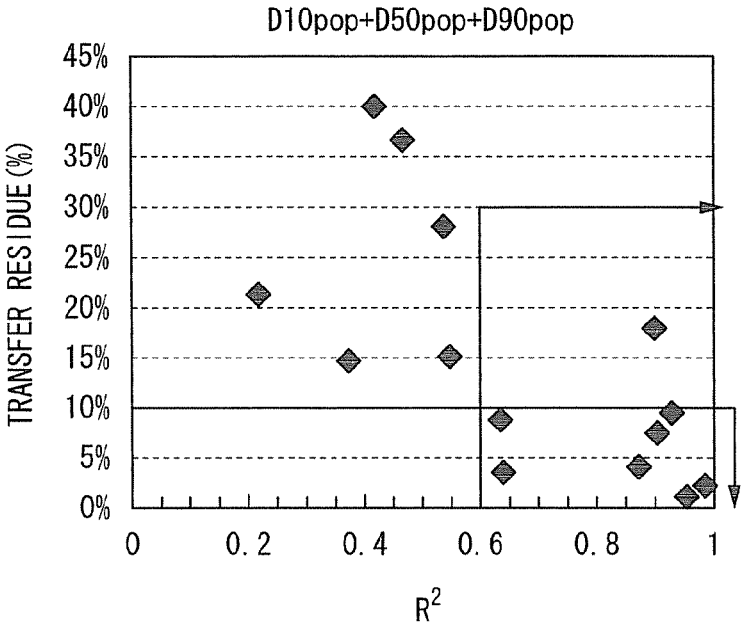
FIG. 15 is a graph showing a relationship between the transfer residual amount of each developer at a transfer voltage of 200 V and the squared multiple correlation coefficient of a linear approximation of the attachment force characteristic versus the square of charge amount of particles with D10pop, D50pop and D90pop.
Figure 16:
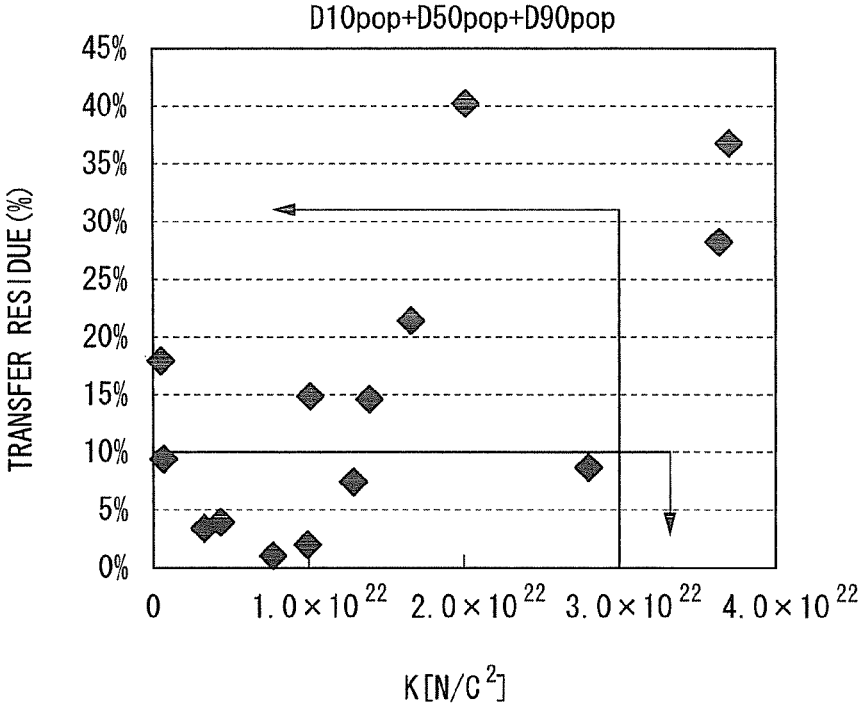
FIG. 16 is a graph showing a relationship between the transfer residual amount of each developer at a transfer voltage of 200 V and the slope of a linear approximation of the attachment force characteristic versus the square of charge amount of particles with D10pop, D50pop and D90pop.
Figure 17:
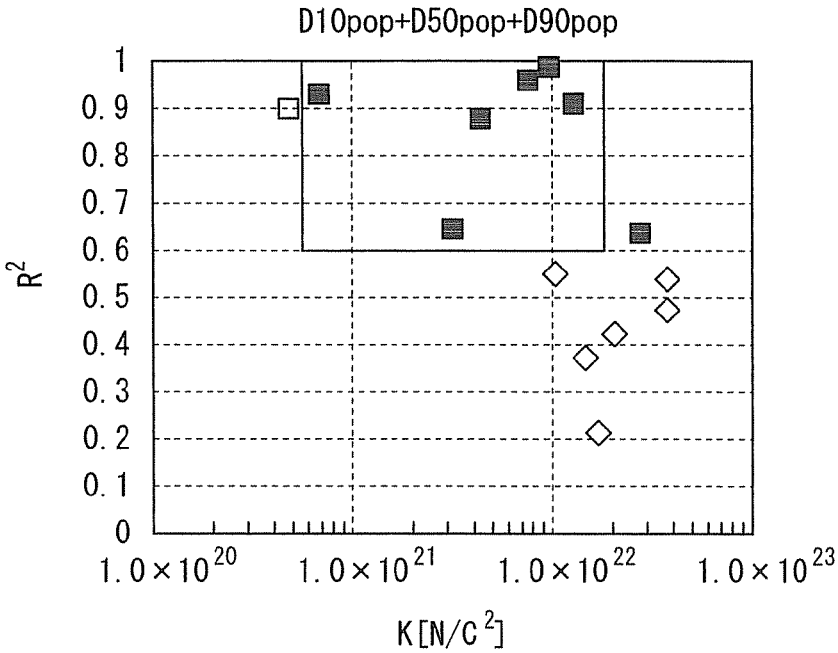
FIG. 17 is a graph showing a relationship between the slope and the squared multiple correlation coefficient of a linear approximation of the attachment force characteristic versus the square of charge amount of particles with D10pop, D50pop and D90pop. ■ indicates a toner (developer) showing a transfer residual amount of 10% or less; and ◇ indicates a toner (developer) showing a transfer residual amount more than 10%.
Figure 18:
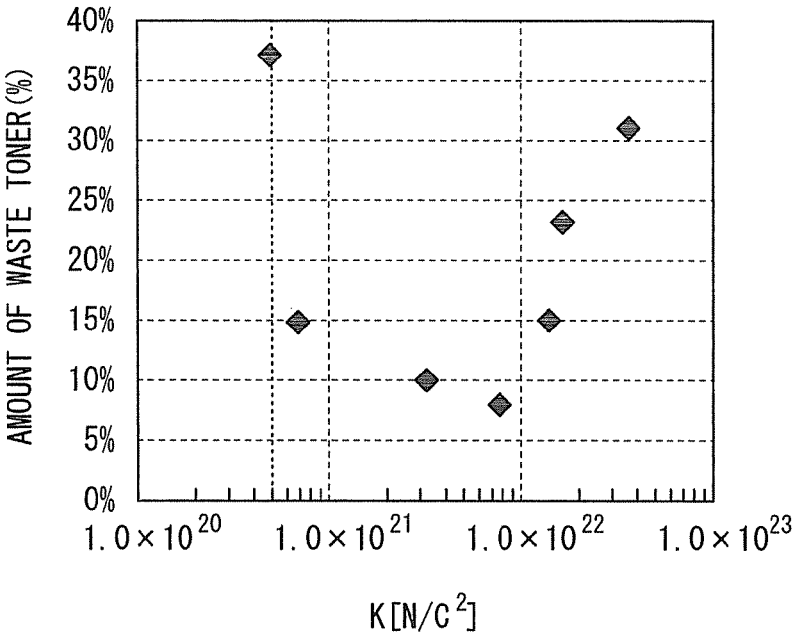
FIG. 18 is a graph showing a relationship between the slope of a linear approximation and the amount of waste toner at 50 k life with an image printing ratio of 6%.

In a similar manner, a relation between the charge amount and the attachment force is determined for the particles with D10pop and D90pop, and 5 measurement values obtained for the respective particles with particle diameters of D10pop, D50pop and D90pop (a total of 15 measurement values) were plotted on a graph to obtain a linear approximation, whereby the slope K and the squared multiple correlation coefficient $R^2$ were obtained. FIG. 15 shows a relationship between the transfer residual amount of each developer at a transfer voltage of 200 V and the squared multiple correlation coefficient of a linear approximation of the attachment force characteristic versus the square of charge amount of particles with D10pop, D50pop and D90pop. It is found that the toner showing a transfer residual ratio of 10% or less is a toner (developer) showing a squared multiple correlation coefficient of 0.6 or more. FIG. 16 shows a relationship between the transfer residual amount of each developer at a transfer voltage of 200 V and the slope of a linear approximation of the attachment force characteristic versus the square of charge amount of particles with D10pop, D50pop and D90pop. It is found that the toner showing a transfer residual ratio of 10% or less is a toner (developer) showing a slope K of $5\times10^{22}$ or less. FIG. 17 shows a relationship between the slope and the squared multiple correlation coefficient of a linear approximation of the attachment force characteristic versus the square of charge amount of particles with D10pop, D50pop and D90pop. ■ indicates a toner (developer) showing a transfer residual amount of 10% or less; and ◇ indicates a toner (developer) showing a transfer residual amount more than 10%. From this graph, it is found that in order to achieve a transfer residual amount of 10% or less, it is appropriate to use a toner showing a slope of a linear approximation of the attachment force versus the square of charge amount of particles with D10pop, D50pop and D90pop of $3\times10^{22}$ [N/C$^2$] or less and a squared multiple correlation coefficient thereof of 0.6 or more. If the slope of a linear approximation of the attachment force versus the square of charge amount is smaller, the ratio of the non-electrostatic attachment force to the electrostatic attachment force becomes too large, and the movement of the toner particles cannot be controlled by the electric field. Accordingly, it is necessary that the slope of a linear approximation of the attachment force versus the square of charge amount be $5\times10^{20}$ [N/C$^2$] or more. For example, a toner on a developer carrier facing a non-image area should stay on the developer carrier side by the force of a development bias. However, the toner showing a small slope of a linear approximation of the attachment force versus the square of charge amount cannot be controlled by the electric field, and therefore, much toner is attached to the non-image area, and such a toner cannot be transferred. Accordingly, when a life test was carried out by a method in which a toner remained on the photoconductor was removed and discarded by a cleaning member, the amount of waste toner was extremely large. FIG. 18 shows a graph on which the amount of waste toner at 50K life versus the slope of a linear approximation of the attachment force versus the square of charge amount is plotted. The printing ratio of the printed image in the life test was 6%.

As described above, according to the invention provides a developer which allows good control of transferability through control of an electric field and allows a reduction in transfer residual amount of the toner.

What is claimed is:

1. An electrophotographic developer, comprising: magnetic particles, and a toner containing toner particles charged with the magnetic particles and having a particle diameter distribution, wherein the toner exhibits cumulative toner weight distributions of both square of charge amount $q^2$ [C$^2$] and attachment force F [N] per particle with respect to a representative toner particle diameter in the particle diameter distribution, giving a linear approximation of plots of the attachment force F [N] versus the square of charge amount $q^2$ [C$^2$] per particle at a plurality of corresponding cumulative toner weight ratios, and the linear approximation satisfies a slope of the linear approximation of from $5\times10^{20}$ to $3\times10^{22}$ and a squared multiple correlation coefficient ($R^2$) of 0.6 or more.

2. The developer according to claim 1, wherein the representative toner particle diameter is a cumulative 50% by number-average particle diameter.

3. The developer according to claim 1, wherein the representative toner particle diameter, three particle diameters including a cumulative 10% by number particle diameter, a cumulative 50% by number particle diameter (cumulative 50% by number-average particle diameter) and a cumulative 90% by number particle diameter as counted from the smaller particle diameter side, and the linear approximation of plots of the attachment force F [N] versus the square of charge amount $q^2$ [C$^2$] for the respective particles having these three particle diameters is with respect to these three particle diameters so as to satisfy a slope of the linear approximation of from $5\times10^{20}$ to $3\times10^{22}$ and a squared multiple correlation coefficient ($R^2$) of 0.6 or more.

4. The developer according to claim 3, wherein the attachment force F [N] versus the square of charge amount $q^2$ [C$^2$] per particle is plotted with respect to the representative three toner particle diameters at five cumulative toner weight ratios of 0.1, 0.3, 0.5, 0.7 and 0.9, respectively.

5. The developer according to claim 1, wherein the attachment force F [N] versus the square of charge amount $q^2$ [C$^2$] per particle is plotted with respect to the representative toner particle diameter at five cumulative toner weight ratios of 0.1, 0.3, 0.5, 0.7 and 0.9.

6. The developer according to claim 1, including toner particles obtained by coating toner base particles with particles for improving fluidity by a wet process.

7. The developer according to claim 6, including toner base particles formed by a wet process.

8. An electrophotographic developer, comprising: magnetic particles, and a toner containing toner particles charged with the magnetic particles and having a particle diameter distribution, wherein the toner exhibits cumulative toner weight distributions of both square of charge amount $q^2$ [C$^2$] and attachment force F [N] per particle with respect to three representative particle diameters including a cumulative 10% by number particle diameter, a cumulative 50% by number particle diameter (cumulative 50% by number-average particle diameter) and a cumulative 90% by number particle diameter as counted from the smaller particle diameter side; wherein the square of charge amount $q^2$ [C$^2$] and attachment force F [N] give a linear approximation of a total of 15 plots of the attachment force F [N] versus the square of charge amount $q^2$ [C$^2$] per particle at five cumulative toner weight ratios of 0.1, 0.3, 0.5, 0.7 and 0.9 is determined, and the linear approximation satisfies a slope of the linear approximation of from $5\times10^{20}$ to $3\times10^{22}$ and a squared multiple correlation coefficient ($R^2$) of 0.6 or more.

9. An image forming method, comprising: developing an electrostatic latent image on an image carrier with a toner containing toner particles triboelectrically charged with magnetic particles and having a particle diameter distribution to form an image of the toner on the image carrier, and transferring the image of the toner onto an intermediate or a final transfer medium; wherein the toner on the image carrier exhibits cumulative toner weight distributions of both square of charge amount $q^2$ [C$^2$] and attachment force F [N] to the image carrier per particle with respect to a representative toner particle diameter in the particle diameter distribution, giving a linear approximation of plots of the attachment force F [N] versus the square of charge amount $q^2$ [C$^2$] per particle at a plurality of corresponding cumulative toner weight ratios, and the linear approximation satisfies a slope of the linear approximation of from $5\times10^{20}$ to $3\times10^{22}$ and a squared multiple correlation coefficient ($R^2$) of 0.6 or more.

* * * * *